US005531545A

United States Patent [19]

Seegmiller et al.

[11] Patent Number: 5,531,545

[45] Date of Patent: Jul. 2, 1996

[54] CABLE BOLT STRUCTURE AND METHOD

[76] Inventors: Ben L. Seegmiller, 143 S. 400 East, Salt Lake City, Utah 84111; John A. Reeves, Jr., 16653 W. Archer Ave., Golden, Colo. 80401

[21] Appl. No.: 440,746

[22] Filed: May 11, 1995

[51] Int. Cl.[6] ..... G21D 21/00

[52] U.S. Cl. ..... 405/259.4; 405/302.2

[58] Field of Search ..... 405/259.1, 259.3, 405/259.4, 288, 302.1, 302.2

[56] References Cited

U.S. PATENT DOCUMENTS

| | | | |
|---|---|---|---|
| 2,667,037 | 1/1954 | Thomas et al. | 405/259.4 X |
| 3,077,809 | 2/1963 | Harding et al. | 405/302.2 X |
| 4,509,889 | 4/1985 | Skogberg et al. | 405/259.3 X |
| 4,954,017 | 9/1990 | Davis et al. | 405/259.3 |
| 4,984,937 | 1/1991 | Karpellus | 405/259.3 |
| 5,015,125 | 5/1991 | Seegmiller | 405/288 |
| 5,026,217 | 6/1991 | Seegmiller | 405/288 |
| 5,215,411 | 6/1993 | Seegmiller | 405/290 |
| 5,230,589 | 7/1993 | Gillespie | 405/259.6 |
| 5,259,703 | 11/1993 | Gillespie | 405/259.6 |
| 5,375,946 | 12/1994 | Locotos | 405/259.4 |
| 5,378,087 | 1/1995 | Locotos | 405/302.2 X |
| 5,441,372 | 8/1995 | Luilkinson | 405/259.5 X |
| 5,458,442 | 10/1995 | Ashmore | 405/259.5 X |

*Primary Examiner*—Roger J. Schoeppel
*Attorney, Agent, or Firm*—M. Ralph Shaffer

[57] ABSTRACT

Cable bolt structure, related components and method for achieving desired ground control of mine roof strata in a dynamic manner; a sustained transverse enlargement, of particular design, of a portion of the cable bolt employed coacts with a tubular member to elastically expand the latter, whereby to generate a heightened frictional resistance as between the cable bolt and such tubular member, for achieving desired strata control.

8 Claims, 4 Drawing Sheets

CABLE BOLT STRUCTURE AND METHOD

FIELD OF INVENTION

The present invention relates to cable bolt structures, related components and method for use in underground mines, such being useful in achieving ground control as to mine roof strata disposed above a particular mine opening.

DESCRIPTION OF PRIOR ART AND BRIEF HISTORY OF CABLE BOLT SUPPORTS

Incorporated by way of reference herein is the inventors' prior filed patent application entitled: CABLE BOLT STRUCTURE AND RELATED COMPONENTS, application Ser. No. 08/332,266 filed 31 Oct. 1994. This application is presently on pending status. Also fully incorporated by way of reference are Seegmiller U.S. Pat. Nos. 5,015,125 and 5,215,411. Other patent literature which is tangentially related include Gillespie U.S. Pat. Nos. 5,230,589 and 5,259,703. All of the above patent literature, including additional literature recited in the inventors' pending patent application above referenced, include other references and teach in rather substantial detail the prior art, and problem situations addressed thereby. The patents of the co-inventor herein, Seegmiller U.S. Pat. Nos. 5,015,125 and 5,215,411, teach what the co-inventor describes as a pressure bubble technique. This is to say, a tubular member is positioned in a selected borehole of mine roof strata and is provided with a reaction plate or bearing plate that abuts the mine roof surface about the borehole. In both the prior and the present applications of the co-inventors herein, a take-up torquing nut is threaded upon the tubular member and directly abuts the bearing plate utilized. Cable bolt structure is disposed in the borehole and is anchored at its remote end within the upper reaches of the hole.

In the present invention the cable bolt structure includes a cable length having a friction-bubble-producing enlargement at or near the proximate end thereof. The cable bolt of course is disposed through the tubular member and the enlargement is initially seated, preferably in a friction fit, for preinstallation purposes, in a counterbore area supplied the bore of the tubular member at its proximate end. In dynamic operation, such enlargement coacts in an interference fit with the primary bore of the tubular member so as to radially expand in its elastic range the tubular member at the section thereof directly contacting and/or proximate the enlargement. The takeup torquing nut is turned so as to provide an initial preload of perhaps one to two tons tension relative to the cable bolt.

In active mode, as the mine strata settles and the mine roof surfaces dilates, the cross-sectional enlargement of the cable bolt, relatively speaking, progresses upwardly relative to the tubular member; or, looking at it from a reverse point of view, and what actually occurs, the descending tubular member experiences a relative movement, i. e. relative to the enlargement, so that a controlled resistance feature is present as between the cable bolt at its enlargement and the radially elastically expanded tubular member supplied.

Particular attention is called to a primary feature in the present invention wherein the enlarged portion of the cable bolt finds its genesis in the provision of either a cylindrical gripping member disposed about and secured to the cable length of the cable bolt or, alternatively, one or more elongated cylindrical members such as roll pins which are situated on the king wire of the cable length interior of the cable strands. Whether roll pins or their equivalent are employed, or whether simply a circular gripping member is used, it is requisite that the surface hardness of these elements be at least of the order of the surface hardness of the cable strands. Thus, what is not wanted is any appreciable plastic deformation of the cylindrical members or roll pins. Any possible scarring by the cable strands of the roll pins or cylindrical member should be held to a minimum. Therefore, the surface hardness of the roll pins or their equivalence, or the cylindrical member, should be held to to a point not less than minus 15 percent of the surface hardness of the cable strands of the cable bolt. When such a condition exists, then the roll pins are fully functional in holding outwardly the cable strands so that these will frictionally engage and indeed radially elastically expand the tubular member proximate that portion thereof which the enlargement engages. It is this elastic expansion of the tubular member that produces the radial, elastic, contractive or compressive forces needed to generate heightened force normals for producing the resistance loading desired. Thus, in such an arrangement, a dynamic resistances offered by the invention achieves tensile loading of from perhaps 23 to even 40 tons. This is a substantial resistance, and one which is needed for appropriate mine roof ground control. Further, this resistance loading is dynamic in operation in that further dilation of the mine roof will maintain or perhaps even increase the resistance loading of the cable bolt.

None of the prior art as known to the applicants teach the concept of producing a circumferential, essentially cylindrical sectional enlargement of a cable bolt wherein there is essentially no plastic deformation experienced as to elements of the cable bolt wherein the requisite radial elastic expansion of the tubular member is nullified.

BRIEF DESCRIPTION OF THE PRESENT INVENTION

In the present invention, a cable bolt installation is provided a selected mine roof borehole produced in mine roof strata. A cable bolt structure is provided a cable length having a proximate end and also a remote end constructed for anchoring within the essentially upper reaches of the borehole. Epoxy anchoring, point anchors, etc., provide the essential end-anchoring of the cable length. Proximate the proximate end of the cable length is structure providing a circumferential enlargement as contributed by one or more cylindrical elements. Such elements are disposed either over the king wire and interior of the cable strands, or over the cable length proper. An elongated tubular member is disposed over the cable and is provided with a reaction plate, either secured to or slipped over the end of the cable bolt. The tubular member is preferably exteriorly threaded, and a torquing nut is threaded thereon and abuts the reaction plate, the latter being designed to thrust against the mine roof surface surrounding the applicable borehole. A tension preload, of the cable bolt, of perhaps 1–2 tons is produced by torquing the nut against the reaction plate.

The interior bore of the tubular member receives the cable bolt and reacts with its circumferential enlargement, operating in essentially the elastic range of the tubular member, in offering a controlled resistance to tubular member travel relative to said cable bolt. To facilitate assembly, it is desire that there be a proximate counterbore or bore enlargement, relative to the proximate end of the tubular member, and that its junction with the bore proper be a conically tapered portion. It is preferred that, initially, the enlarged portion of the cable bolt be in friction-fit relationship relative to the enlarged bore portion; subsequently, the nut is tightened for an initial desired preload. As the mine roof strata tends to settle, the mine roof surface dilates so as to urge the tubular member downwardly. The latter's coaction with the enlargement of the cable bolt produces a circumferential, at least partially elastic enlargement of the tubular member at that portion thereof which is transversely proximate such enlargement. This creates a moving pressure bubble, as between the tubular member and the enlargement, for increasing travel constraint of the enlargement area, thereby offering resistance to mine roof strata settling.

As to the circumferential enlargement of the cable bolt, this is produced either through the inclusion of one or more cylindrical members, disposed on the king wire of the cable length, or an internally serrated cylindrical member position upon the cable length and constructed to grip the cable length in an increasing manner as the pressure bubble is produced. The method inherent in the invention, broadly stated, is to supply cable bolt anchoring structure in a mine roof, wherein dilation of the roof, as produced through settling of roof strata, is constrained through controlled descent as is regulated through the generation of a pressure bubble, i.e. by the radial elastic pressure, exerted circumferentially about a cylindrically enlarged portion of the cable bolt of the structure, by a tubular member expanded elastically thereabout and secured relative to a mine roof reaction plate, as by torquing nut structure or otherwise.

OBJECTS

Accordingly, the principal object of the present invention is to provide new and improved cable bolt structure and related components.

A further object of the invention is to provide a cable bolt installation having a cable bolt constructed in such manner that the same has an enlargement capable of producing an elastic radial expansion within a tubular member employed, whereby to rely upon the radial compression of such tubular member against the periphery of the cable bolt enlargement to produce a dynamic-control resistance relative to relative motion between the cable bolt and the tubular member employed.

A further object is to provide an improved cable bolt structure wherein the cable length constituting a principal portion of the structure includes a king wire, multiple strands wrapped about said king wire, and one or more hardened cylindrical elements disposed along said king wire for expanding outwardly the strands immediately adjacent the cylinders, thereby permitting said strands to coact in interference fit relationship with a tubular member so as to radially expand the tubular member in its elastic range, this for producing the compressive forces needed to supply the dynamic frictional resistance characteristic desired relative to the cable bolt and its tubular member.

An additional object is to provide a cable bolt member having an enlargement taking the form of a cylindrical member that grips the peripheral strands of the bolt length, a side wall of the cylindrical member being slit to provide for structural circumferential compression without chancing plastic deformation of such cylindrical member.

A further object is to provide a method for achieving ground control in mine roof strata, this by supplying a dynamic resistance characteristic which in effect is spring-loaded by virtue of the elastic expansion of a supplied tubular member relative to the enlargement of the cable bolt with which the later cooperates.

BRIEF DESCRIPTION OF DRAWINGS

The present invention together with objects and advantages thereof may best be understood by reference to the following description taken in connection with the accompanying drawings in which.

For convenience of illustration and understanding, the transverse dimensions of the structural features relating to the tubular member and cable bolt transverse enlargement comprising the pressure bubble are shown in greatly enlarged scale.

DETAILED DESCRIPTION OF PREFERRED EMBODIMENTS

Figures 1, 2:
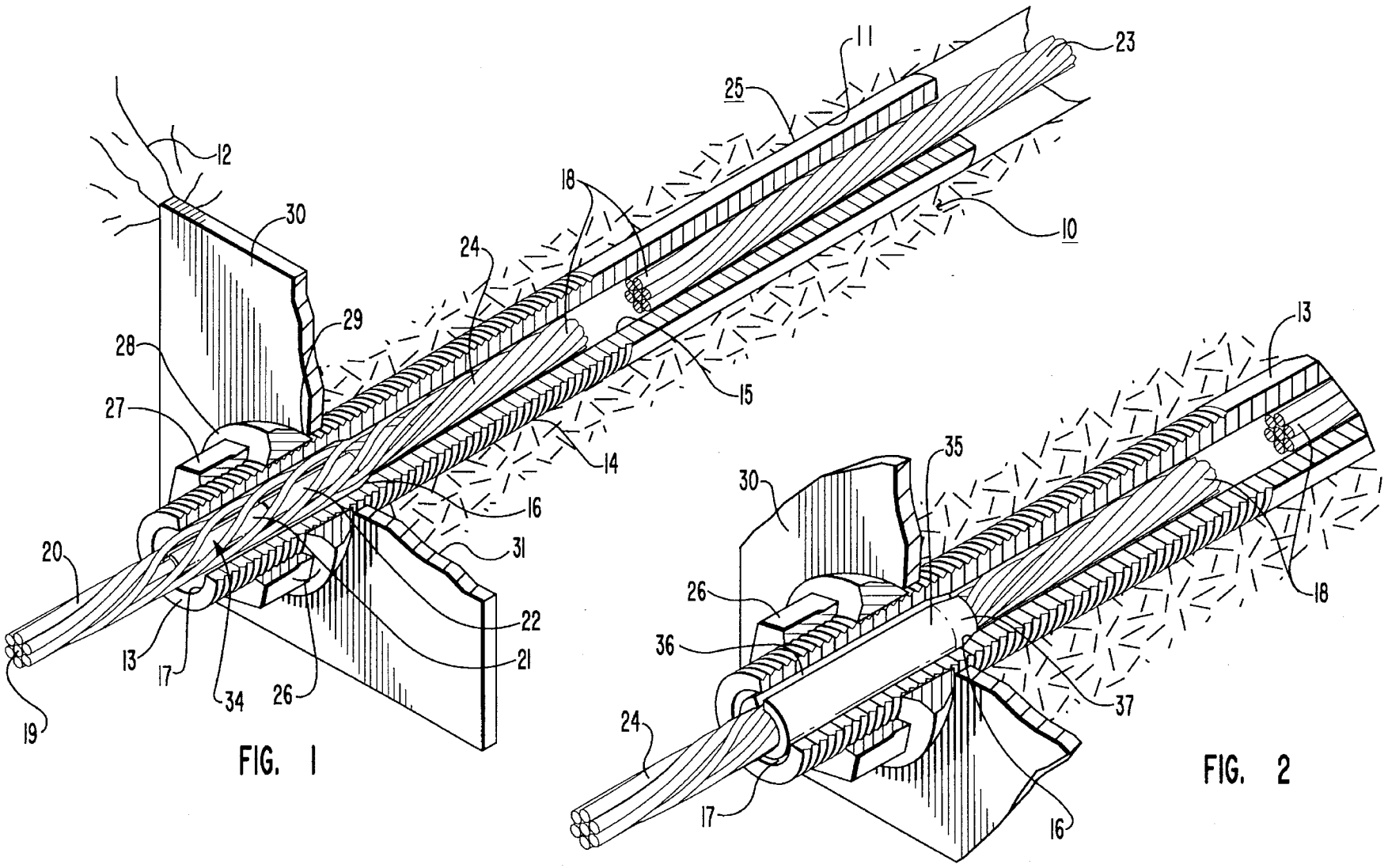
FIG. 1 is a perspective view, partially broken away and sectioned for convenience of illustration, of the ground control structure constructed in accordance with the basic principles of the present invention.
FIG. 2 is similar to FIG. 1 but illustrates an alternate structure, for achieving a cable bolt enlargement section, relative to that structure seen in FIG. 1.

In FIG. 1 mine roof strata 10 has a vertical borehole 11 which passes through mine roof surface 12. Disposed in the borehole is tubular member 13, the same having a plurality of external threads 14 as indicated. The interior bore 15 of the threaded tubular member has an interior chamfered shoulder area 16 which is conically shaped and which joins an enlarged counter bore area 17.

Positioned within bore 15 is a cable length 18 comprised of a king wire 19 and a series of strands 20 helically wound thereabout. Of importance in the invention is the inclusion of one or more cylindrical members 21 and 22 which are pressed end-to-end over the king wire and about which the strands 20 are rewound. More will be said about this later. At this juncture it is important to note that the cable length 18 has an upper end 23 that is anchored by epoxy 23A (see FIG. 6) or otherwise into the upper reaches of borehole 11. The end of extremity 23 may include any one several types of structures, e.g. as common to the art, for aiding in the epoxy securement and anchoring of the cable length within the bore hole.

Cable bolt 24 may be thought of as including the cable length 18 and the cylindrical members 21 and 22, while the cable bolt structure 25 may be considered as including cable bolt 24, plus tubular member 13 and torquing nut 26. Torquing nut 26 will include, of course, an interiorly threaded nut body 27 and a forward hemispherical, self-centering head portion 28. This allows for self-centering of the nut and associated structure relative to aperture 29 in the bearing plate or reaction plate 30, positioned about the bore hole and abutting the mine roof surface at 31.

Figure 3A:
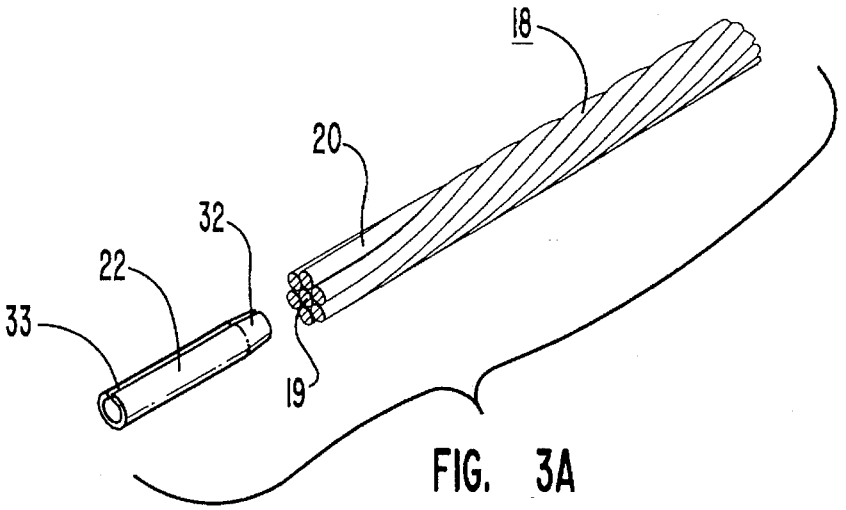
FIG. 3A illustrates in perspective the combination of a cable length with a roll pin type of cylindrical element to be disposed over the king wire or central wire of such cable length.
Figure 3B:
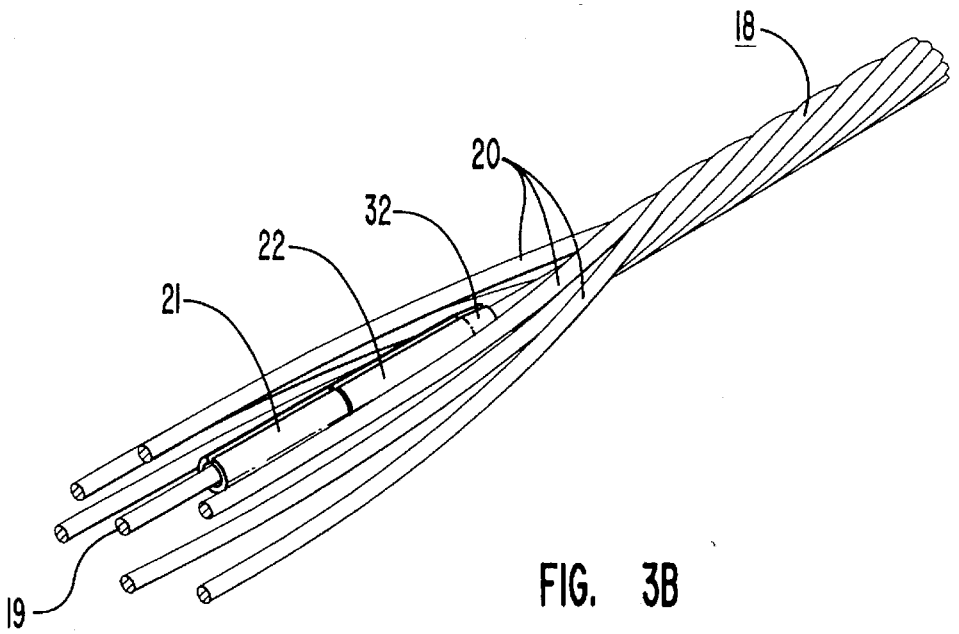
FIG. 3B is similar to FIG. 3A but illustrates that the strands are temporarily unwound so as to provide access to the king wire for a preferable press fit of one or more cylindrical members such as roll pins which are urged together to a desired intermediate point along the king wire within the cable length proper.
Figure 3C:
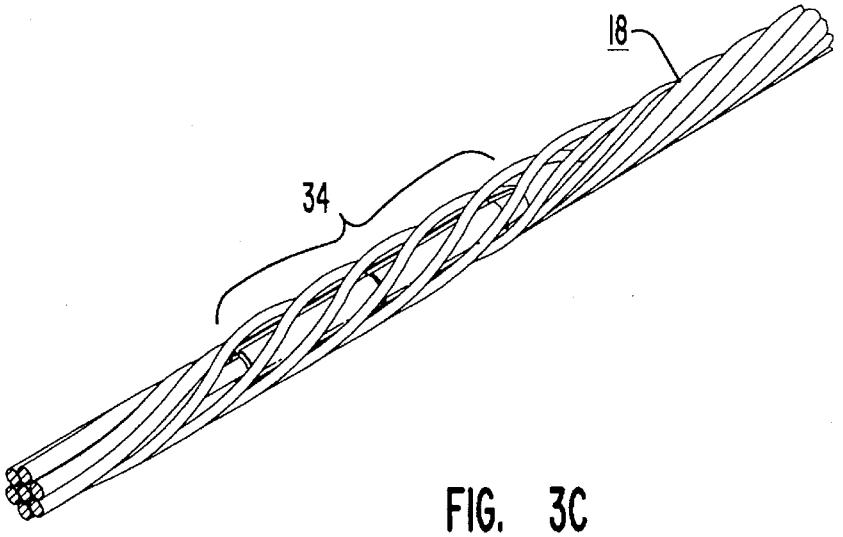
FIG. 3C illustrates the structure of FIG. 3B wherein the outer strands are rewound so as to encase, by the helical strands of the cable, the hardened metal enlargements or roll pins within the cable length.

In FIG. 3A it is seen that cable length 18 is about to receive cylindrical member 22. The latter may take the form of a hardened roll pin having a surface hardness of the order of not less than that of the strands 20, minus 15%, of the cable length. In FIG. 3A cylindrical member 22 takes the form of a roll pin having a sidewall slot 33 and a long tapered end portion at 32. In FIG. 3B the makeup of the cable bolt comprehends temporarily unwinding the strands 20 so that the cylindrical elements 21 and 22 can be pressed on to the king wire 19. The leading, conically tapered edge 32 of member 22 aids in reducing the likelihood of cable failure. In any event, once the tubular cylindrical members are in place, being installed end-to-end, then the cable strands 20 are rewound so that the cable bolt achieves the structural integrity as seen in FIG. 3C. The greater the pressure bubble effect desired, the greater the over-all length to be selected, whether unitary or segmented, of the the cylindrical element(s) 21, 22.

In installation the borehole is first generated and the cable bolt is thrust therein and spun by means of a tool gripping the lower end of cable length 18. An epoxy or other agent 23A (see FIG. 6) is employed for securing the upper end 23 within the upper reaches of the bore hole. The bearing plate 30, having aperture 29 is inserted over cable bolt 24 and externally threaded tubular member 13 freely passes through aperture 29, with torquing nut 26 being threaded thereon.

For most installations it will be preferred that tubular member 13 will be pre-installed over the cable bolt 24. The interior counter bore area 17 is preferably dimensioned to receive the cable bolt 24, with the included cylindrical members 21 and 22 in a friction fit, for temporary holding purposes. In any event, and once the upper end of the cable bolt at 23 is securely anchored within the borehole, through upward thrusting and spinning of the cable bolt in a conventional manner, a tool will be employed to tighten nut 26 so as to supply to the cable length a tension preload of perhaps from 1 to 2 tons.

In operation, the settling of the mine roof strata 10 above mine roof surface 31 will produce a dilation of such surface a downward direction, thereby causing the bearing plate 30 and also the nut 26 and tubular member 13 assembly likewise to move incrementally downwardly. This causes the enlargement portion 34, see FIG. 3C, as produced by the inclusion of cylindrical members 21 and 22, to advance from the press-fit area within the counterbore of the threaded tubular member upwardly into the primarily bore area. This operation acts to expand radially the metal tubular member 13 proximate the area of members 21 and 22. Such radial expansion is at least primarily within the elastic range of the material of the tubular member so that such action generates, by the tubular member 13, a radial, inward, elastic compression force, serving to enhance the frictional, elastically compressive holding power of the tubular member relative to the cable bolt. Further dilation of the mine roof surface will produce a further riding up, relatively speaking, of the enlargement portion of the cable bolt with respect to tubular member 13. Accordingly the pressure bubble that is produced advances upwardly, relatively speaking, as to cable bolt 24. Again, pressure bubble is defined as the frictional resistance generated through the coaction by and between the cable bolt, with it enlarged portion as previously described, and the elastically expanded material of tubular member 13. Such a friction generating bubble travels upwardly, relatively speaking, in accordance with the downward settling of mine roof strata.

At this juncture it is important to note that cylindrical members 21 and 22, preferable comprising roll pins, will generally be case hardened and approach the surface hardness characteristics of tool steel. What is not wanted is any significant plastic deformation of members 21 and 22. Rather, these should preserve the outward integrity of the strands such that the strands 20, such that the latter are useful to urge outwardly the sidewall of the tubular member 13 to produce the elastic compressive forces as previously mentioned. Therefore, the surface hardness of the members should be not less than 15 percent the surface hardness of the strands 20.

The structure in FIG. 2 is similar to that seen in FIG. 1 with the exception that this time, in lieu of the inclusions of the cylindrical members 21 and 22 one the king wire, a new cylindrical member 35 is employed which is pressed over the cable length in the manner seen in FIG. 2. Cylindrical member 35 is preferably case hardened and includes a sidewall slot 36 and also a tapered forward leading edge 37. For ease of installation, the cylindrical member 35, gripping the cable length, is lightly frictionally seated within counterbore area 17 such that the forward tapered edge or end 37 engages frusto-conically formed section 16 of the bore area of tubular member 13. Nut 26 is disposed in place as indicated and torqued for desired pre-load. The settling of mine roof strata will produce a downward movement of tubular member 13 relative to the cable bolt so that, relatively speaking, cylindrical member 35 as clamped on the cable travels upwardly into the bore area of tubular member 13. This advance passed the area 16 produces, again, a pressure bubble or elastic expansion of the tubular member 13 at that region which is proximate to cylindrical member 35.

Whether the structure in FIG. 1 or FIG. 2 be used, it has been observed that resistant pressures of the order of 28 to 40 tons can be generated, thus producing a controlled settling of mine roof strata through tensioned integrity of the cable bolt installation prior to approaching the ultimate failure point of the cable.

Figure 4A:
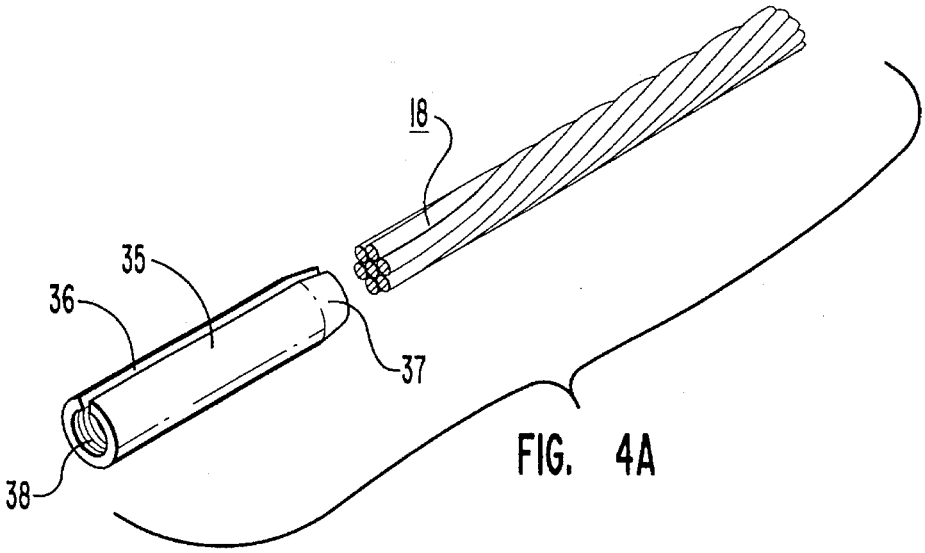
FIGS. 4A and 4B are similar to FIGS. 3A–3C excepting that, in the case of these present figures, an external cylindrical member is disposed about the cable length.
Figure 4B:
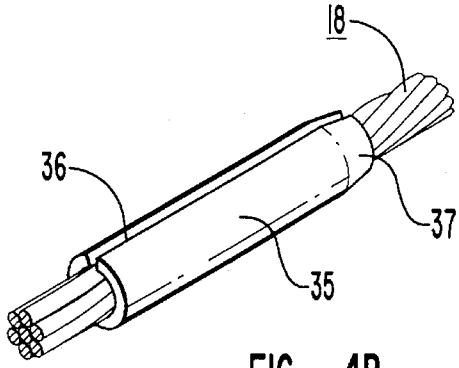

FIGS. 4A and 4B amplify upon the assembly of cylindrical member 35 and cable length 18. For fabricating cylindrical member 35, a threaded nipple can be supplied to provide gripping serrations 38. The nipple us turned down to proper, interference-fit size, and wall slot 36 is produced as well as forward tapered portion 38. The unit is then case hardened to a point approaching the characteristics of tool steel, i.e. by heating with a rosebut acetylene torch to 900 degrees F. and then quenching in a bath of oil, and made ready for installation on a selected cable length. The threads 38 serve as serrations to grip against the strands of the cable length, providing a non-slip junction, and which gripping action is enhanced through the pressure bubble effect above recited.

Figure 5:
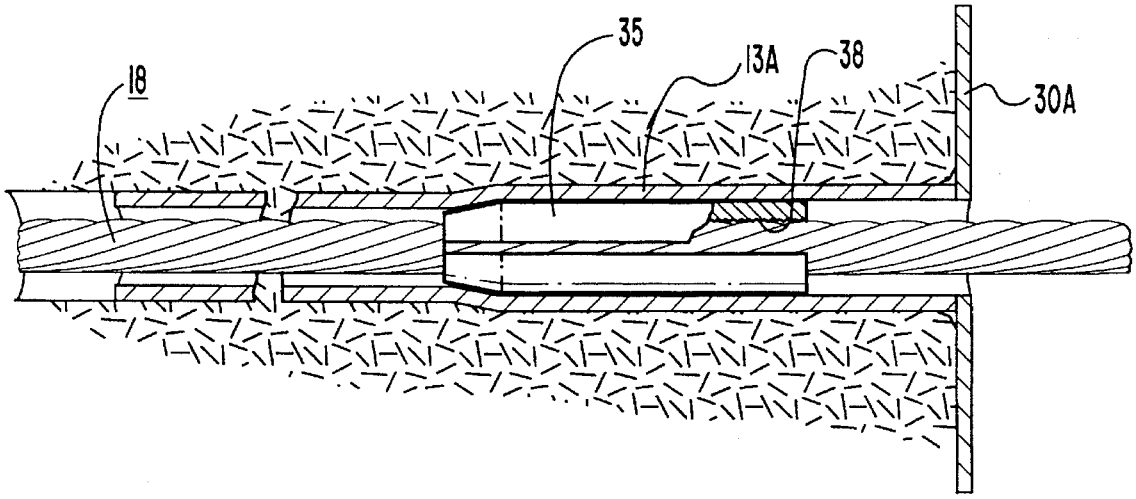
FIG. 5 illustrates an installation wherein a bearing plate is secured to a central tubular member disposed in the mine roof borehole, the cable bolt this time including an external peripheral cylindrical member as seen in FIG. 4B.

For pre-load and adjustment purposes, it is very much desired that a threaded tubular member be used in conjunction with the torquing nut 26 as seen in FIGS. 1 and 2. It is possible, however, for the installation to be used as seen in FIG. 5, wherein tubular member 13A is now secured to bearing plate 30A by welding or otherwise, with the enlargement, see 35, being used with cable length 18 in the manner as previously described. Of course, a nut or other attachment means can be employed to secure the bearing plate 30A with respect to tubular member 13A.

Figure 6:
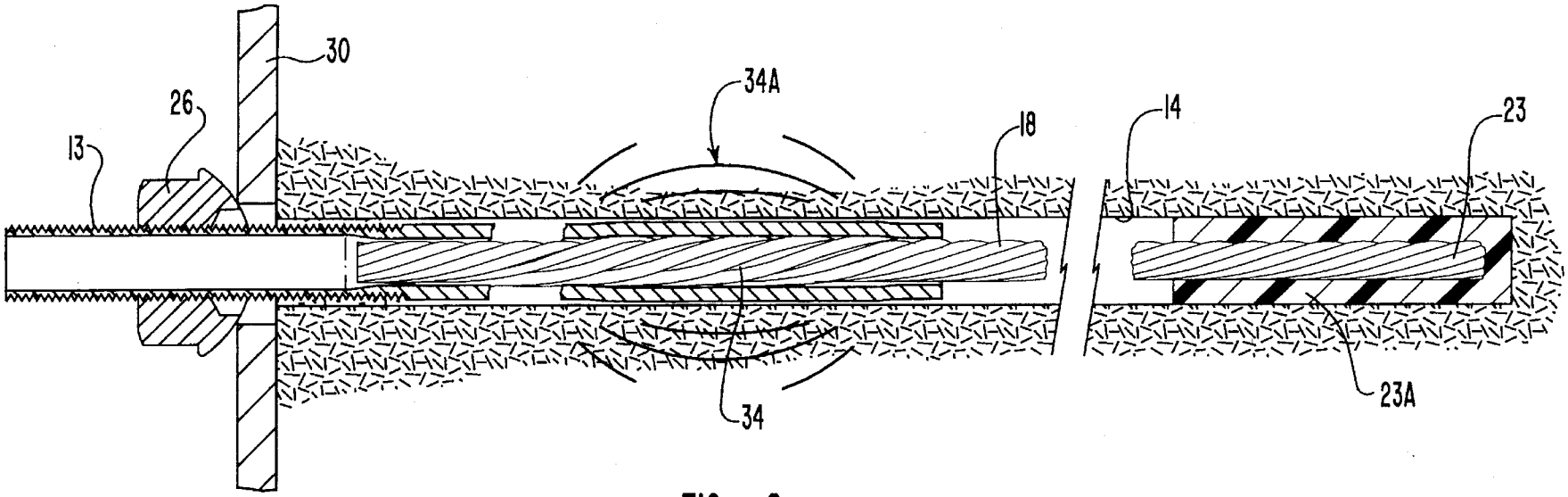
FIG. 6 illustrates the condition wherein the structure of FIG. 1, for example, is installed and the mine roof strata settles so as to produce a relative downward movement, i.e., to the left in FIG. 6, of the tubular member so that the enlarged area of the cable bolt advances relatively speaking, upwardly through the upper portion of the tubular member.

FIG. 6 illustrates the generation of the pressure bubble 34A relative to the enlargement 34 of the cable bolt.

Figure 7:
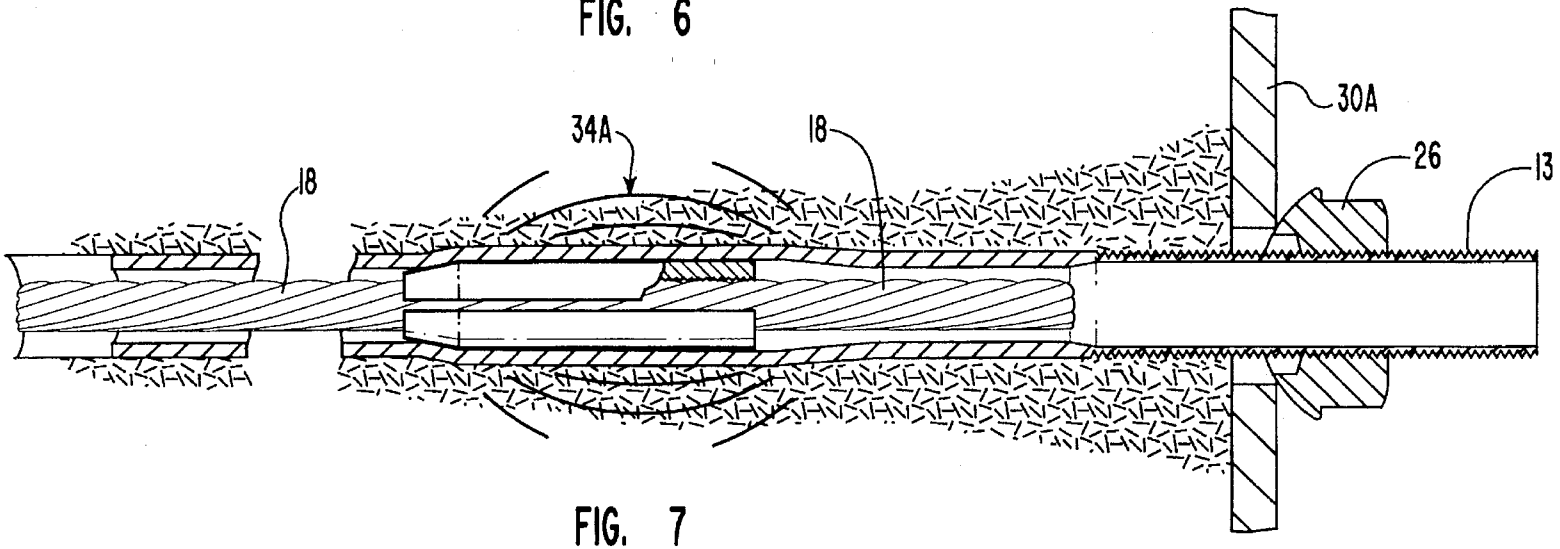
FIG. 7 is similar to FIG. 6 but illustrates the pressure bubble being created as between the cylindrical member shown and the radially expanded inner wall of the tubular member of the installation.

FIG. 7 illustrates the generation of a similar pressure bubble 34A relative to the cable bolt enlargement as occasioned by the inclusion of member 35, see FIG. 5.

Inherent in the invention as shown and described is a method for controlling the dilation of a mine roof, as produced through settling of strata thereabove, comprising the steps of:

(1) providing a borehole;

(2) anchoring a cable bolt at its remote end within said bore hole;

(3) providing an elongated, cylindrical enlargement of said cable bolt at its proximate end;

(4) providing an elongated, exteriorly threaded metal tubular member of radially elastic expansion characteristics, said metal tubular member receiving said cable bolt at said cylindrical enlargement in a tube-expansion interference fit;

(5) providing for said tubular member a reaction plate and also a torquing nut, threaded upon said tubular member and backing said reaction plate, (6) preloading said cable bolt through tightening said torquing nut against said reaction plate, and (7) creating a controlled, travel resistant pressure bubble as between said cable bolt and said tubular member, whereby to retard in a controlled resistive manner the descent of said tubular member relative to said cable bolt in response to dilation of said mine roof as occasioned through strata settling.

While particular embodiments of the present invention have been shown and described it will be obvious to those skilled in the art that various changes and modifications may be made without departing from the essential aspects of the invention and, therefore, the aim in the appended claims is to cover such changes and modifications as fall within the true spirit and scope of the invention.

We claim:

1. A mine roof cable bolt structure including, in combination: an elongated metal tubular member having a hollow interior, reaction structure provided said tubular member, a cable bolt provided a cylindrical member whereby to create a peripheral sectional enlargement, as to a portion of said cable bolt, which has a nominal transverse peripheral dimension greater than the corresponding transverse cross-section of said hollow interior of said tubular member, said sectional enlargement thereby cooperating with said tubular member within an interference fit, whereby to expand radially outwardly said tubular member in said tubular member's elastic range, for creating a pressure bubble, whereby to offer elastic resistance to movement of said metal tubular member, over said sectional enlargement.

2. The mine roof cable bolt structure of claim 1 wherein said cable bolt is provided with an interior axial king wire and multiple cable strands helically wound over said king wire whereby to provide said peripheral sectional enlargement, said cylindrical member being mounted on said king wire for expanding said strands in the region of said cylindrical member.

3. Mine roof cable bolt structure including, in combination: an elongated exteriorly threaded metal tubular member having remote and proximate ends, said tubular member having an internal bore provided with and tapering into a bore enlargement at said proximate end thereof, a cable bolt comprising a cable length having a king wire and multiple strands wrapped about said king wire, said cable bolt having a transverse enlargement, said enlargement cooperating in an installed press-fit within said bore enlargement, a reaction member disposed upon said tubular member, a torquing nut threaded upon said tubular member and backing said reaction member, said enlargement of said cable bolt being constructed to enter into said bore in an interference fit, whereby to expand elastically said tubular member as said enlargement proceeds in relative longitudinal movement within said bore, whereby to create a pressure bubble interference fit for resistively controlling relative movement between said enlargement and said tubular member, said enlargement being at least in part formed by an elongated cylindrical member of surface hardness of the order of that of said strands of said cable length.

4. Cable bolt apparatus for securement over an external, apertured mine roof bearing plate and within a strata borehole aligned with said bearing plate at its aperture, said cable bolt apparatus including, in combination: an elongated tubular member having an internal bore, external threads, and a peripherally enlarged, proximate bore area contiguous with said bore; a cable length comprising a king wire and helical strands wrapped thereabout, said cable length having a remote end constructed for securement within said borehole and a proximate, peripherally enlarged end nominally mounted in friction-fit relationship within said enlarged, proximate bore area; nut means threaded upon said tubular member and constructed for abutting against said external bearing plate and thereby preloading said cable length, said tubular member and said peripherally enlarged end of said cable length being mutually constructed whereby to provide, through elastic expansion of said tubular member and consequent radial compression thereof against said peripherally enlarged end, a pressure bubble offering controlled resistance to relative movement between said cable length and said tubular member in response to mine roof strata settling.

5. The cable bolt apparatus of claim 4 wherein said king wire is provided a cylindrical member, resistant to plastic deformation, disposed upon said king wire and forming with said strands said peripherally enlarged end.

6. The cable bolt apparatus of claim 4 wherein said king wire is provided with a series of end-to-end disposed cylindrical members, respectively resistant to plastic deformation, disposed upon said king wire and forming with said strands said peripherally enlarged end.

7. The cable bolt apparatus of claim 4 wherein a hardened cylindrical, tubular member having a slit side wall is provided said cable length, whereby to form said peripherally enlarged end.

8. A method of controlling the dilation of a mine roof, as produced through settling of strata thereabove, comprising the steps of:

(1) providing a bore hole;

(2) anchoring a cable bolt at its remote end within said borehole;

(3) providing an elongated, cylindrical enlargement of said cable bolt at its proximate end;

(4) providing an elongated, exteriorly threaded metal tubular member of radially elastic expansion characteristics, said metal tubular member having a hollow interior nominally less in transverse cross-section than that of said cylindrical enlargement, said metal tubular member thereby receiving said cable bolt at said cylindrical enlargement in a tubular-member-elastic-expansion interference fit;

(5) providing for said tubular member a reaction plate and also a torquing nut, threaded upon said tubular member and backing said reaction plate;, (6) preloading said cable bolt through tightening said torquing nut against said reaction plate, and (7) creating a controlled, travel resistant pressure bubble as between said cable bolt and said tubular member, whereby to retard in a controlled resistive manner the descent of said tubular member relative to said cable bolt in response to dilation of said mine roof as occasioned through strata settling.

* * * * *